United States Patent [19]

Sako et al.

[11] Patent Number: 4,845,455

[45] Date of Patent: Jul. 4, 1989

[54] THERMALLY-SENSIBLE OVERCURRENT PROTECTIVE RELAY INCLUDING HEATER HOLDER

[75] Inventors: Yuji Sako; Shigeharu Ootsuka, both of Aichi, Japan

[73] Assignee: Mitsubishi Denki Kabushiki Kaisha, Japan

[21] Appl. No.: 126,075

[22] Filed: Nov. 24, 1987

[30] Foreign Application Priority Data

Nov. 26, 1986 [JP] Japan ..... 61-180400[U]
Feb. 9, 1987 [JP] Japan ..... 62-26440

[51] Int. Cl.[4] ..... H01H 71/16
[52] U.S. Cl. ..... 337/49; 337/36
[58] Field of Search ..... 337/49, 48, 47, 46, 337/45, 36

[56] References Cited

U.S. PATENT DOCUMENTS 3,638,158 1/1972 Thorne ..... 337/49
4,635,020 1/1987 Sako ..... 337/49
4,652,847 3/1987 Sako ..... 337/49

*Primary Examiner*—H. Bromme

*Attorney, Agent, or Firm*—Lowe, Price, Leblanc, Becker & Shur

[57] ABSTRACT

Disclosed herewith is a thermally-sensible overcurrent protective relay, which comprises normally-closed contact means, operation means, a plurality of bimetals, a communicating plate, a heater mounted on each bimetal and electrically coupled to at least one of main circuit terminals for a power-source side and a load side, a bimetal retainer electrically coupled to the other main circuit terminal, a first groove, a second groove and a heater holder having a pin fitted in a through hole formed in the bimetal retainer. The operation means opens or closes the normally-closed contact means. The same current as flows through a main circuit to be controlled flows through the bimetals. The communicating plate transmits mechanical deforming force of the bimetals to the operation means so as to open the normally-closed contact means. The heater, when generating heat, causes a mechanical deformation on the bimetals. The bimetal retainer secures one end of each bimetal. The first groove securely holds the main circuit terminals, while the second groove securely holds a connecting section between the bimetal retainer and the bimetals.

6 Claims, 17 Drawing Sheets

THERMALLY-SENSIBLE OVERCURRENT PROTECTIVE RELAY INCLUDING HEATER HOLDER

BACKGROUND OF THE INVENTION

1. Field of the Invention

The present invention generally relates to a thermally-sensible overcurrent protective relay, and more particularly, to an overcurrent protective relay where disconnection or broken of a heater can be avoided.

2. Description of the Related Art

Thermally-sensible overcurrent protective relays have been widely used to prevent the overcurrent from being flown through a main device which should be controlled, e.g., induction motors during overload conditions. These overcurrent protective relays are known in the field from, for instance, U.S. Pat. Nos. 4,652,847 and 4,635,020 issued to the Applicant.

One of the conventional thermally-sensible overcurrent protective relays will now be described with reference to FIGS. 1 through 7.

FIG. 1 is a longitudinal section of the conventional relay; FIG. 2 is a sectional view taken along a line A—A in FIG. 1; FIG. 3 is a sectional view taken along a line B—B in FIG. 1; FIG. 4 is a sectional view taken along a line C—C in FIG. 1; FIG. 5 is a perspective view illustrating basic component elements of a snapping inverter; FIG. 6 shows a movable contact element; and Fig. 7 shows an actuating lever.

In FIG. 1, there are shown a case 1, a cover 2, bimetals 3 provided for individual phases (three phases in this example), and heaters 4 wound around the bimetals 3 respectively to generate heat when a main circuit current flows therein. When mainly heated by the heater 4, the bimetal 3 is deformed with a curvature as represented by a dotted line in FIG. 1. A load-side main circuit terminal 5 (FIG. 4) has a tongue 5A to which an upper end of the bimetal 3 is joined and secured. The load-side main circuit terminal 5 is anchored to the case 1 by means of a clamp screw 6, and a terminal screw 7 for connecting a load-side main circuit (external circuit) is fastened to one end 5B of the terminal 5. Also, a lower end 4B of the heater 4 is electrically connected to a lower end of the bimetal 3 by some suitable means such as welding.

In a main circuit terminal for a power supply side 40, as shown in FIG. 4, an upper end 4A of the heater is electrically connected to its one end 40A by welding or similar means. Meanwhile, a left end 40B of the main circuit terminal 40 is screwed to a terminal of a power supply circuit used for an electromagnetic contactor (not shown) and so forth.

In FIG. 4, a communicating plate 8 is kept in engagement with the fore end 3A of the bimetal 3 of each phase so as to transmit the deformation of the bimetal 3. In the example of FIG. 1, the communicating plate 8 is so disposed that its left end depresses a lower end of a temperature compensating bimetal 9. Further, an actuating lever 10 is disposed to be rotatable around a shaft 11 with an upper end of such temperature compensating bimetal 9 anchored to the lever 10 (see FIG. 1).

The shaft 11 is held at its two ends by a lever supporting member 12 as shown in FIG. 3. The lever supporting member 12 is retained, at an inner corner 12A of its L-shaped bend, in abutment against an edge 1A of the case 1 and is thereby held at a fulcrum while being pressed against an adjusting screw 13 through a first tongue 12B. In the meanwhile, a second tongue 12C is elastically urged leftward, as viewed in FIG. 1, by a leaf spring 14.

Consequently, the lever supporting member 12 is rotatable around the edge 1A by turning a control knob 15 disposed above the adjusting screw 13. In addition, the shaft 11 attached to the lever supporting member 12 is positionally changed substantially in the horizontal direction in FIG. 1, thereby controlling the operating current in response to the curvature of the bimetal 3 curved by the current generated from the heater 4.

A movable contact element 16 is composed of a thin metal plate having sufficient elasticity and conductivity. As illustrated in FIG. 5, the movable contact element 16 is produced by punching a plate to have an inner beam portion 16A and outer beam portions 16B. A U-shaped leaf spring 17 is interposed between the fore end of the inner beam portion 16A and the outer beam portions 16B in such a manner as to depress the contact element 16 with elastic urge. A contact portion 16C of the movable contact element 16 is disposed opposite to and in abutment against a fixed contact element 18 for a normally-closed contact, thereby constituting a normally-closed contact mechanism. Then, a lower end 16E of the movable contact element 16 shown in FIG. 6 is clinched firmly via a through hole 16G to a normally-closed movable terminal 19 shown in FIG. 1. This terminal 19 is anchored to the case 1 by means of a clamp screw 20 as illustrated in FIG. 3.

The inner beam portion 16A of the movable contact element 16 is inserted into a substantially T-shaped slit 10A formed at the fore end, or tip of the actuating lever 10 shown in FIG. 6. An upper end 16F extending from the outer beam portion 16B of the movable contact element 16 is engaged with a groove 21A formed at the left end of a cross bar 21. The cross bar 21 is guided by the case 1 to be movable horizontally, as viewed in FIG. 1.

In FIG. 2, there are shown normally-open contact elements 22 and 23, and furthermore a normally-open fixed contact element 24 and a normally-open movable contact element 25 as shown in FIGS. 1 and 2.

Each of a normally-open fixed contact element 24 and a normally-open movable contact element 25 is composed of a thin metal plate having sufficient elasticity and conductivity. Such two contact elements 24 and 25 are clinched and fastened respectively to a normally-open fixed terminal 22 and a normally-open movable terminal 23 shown in FIG. 2. A back surface 25A of the upper distal end of the normally-open movable contact element 25 in its positional change is disposed in abutment against a projection 21G of the cross bar 21. A reset bar 26 is held slidably by the case 1 and is displaceable vertically in FIG. 1. Normally, the reset bar 26 is elastically urged at its edge 26C upward by a return spring 27 and is retained at an upper-limit halt point. In this state, a lower vertical plane 26D of the reset bar 26 is kept in abutment against a curved portion 24A formed on a back surface of the normally-open fixed contact element 24. Then, an inclined portion 26A of the reset bar 26 is slid and depressed against such curved portion 24A in accordance with the downward displacement of the reset bar 26, thereby displacing the normally-open fixed contact element 24 rightward in FIG. 1.

When such conventional thermally-sensible overcurrent protective relay is used in an auto-reset system, first the reset bar 26 is depressed downward to displace a changeover plate 30 leftward in FIG. 1, so that the fore end of the changeover plate 30 is inserted into a lock hole 26B formed in the reset bar 26, and the protrusion 1B of the case 1 is fitted into a recess on the bottom of the changeover plate 30, whereby the reset bar 26 is restricted with respect to its upward return.

In the conventional thermally-sensible overcurrent protective relay of the structure mentioned, the following operation is performed.

In FIG. 4, a main circuit current flows from the main circuit terminal for the power supply side 40 via the heater 4 and the bimetal 3 to the load side main circuit terminal 5. An electric wire (not shown) is connected to the terminal screw 7 fastened to one end 5B of the load-side main circuit terminal 5 and is further connected to a load (not shown) such as an induction motor. Consequently, the main circuit current becomes equivalent to the load current. Due to the Joule heat loss caused by such main circuit current in the bimetal 3 and the heater 4, the bimetal 3 is heated and curved as represented by a dotted line in FIG. 1.

Upon occurrence of an overcurrent condition in the load, the main circuit current becomes higher to further increase the curvature (bending curve) of the bimetal 3 represented by the dotted line in FIG. 1, hence causing its further displacement leftward. As a result, the communicating plate 8 is depressed by the fore end 3A (bottom as viewed in FIG. 1) of the bimetal 3 and is thereby displaced leftward in FIG. 1. In response to such leftward displacement of the communicating plate 8, a coupled assembly of the temperature compensating bimetal 9 and the actuating lever 10 is pressed by the left end of the communicating plate 8 and is thereby rotated clockwise around the shaft 11, so that the inner beam portion 16A of the movable contact element 16 in abutment against the periphery of the substantially T-shaped slit 10A at the fore end of the actuating lever 10 is bent rightward in FIG. 1.

When the inner beam portion 16A thus bent and displaced has reached a dead center point determined by the relationship between the elastic urge of the U-shaped leaf spring 17 and the spring force of the outer beam portion 16B of the movable contact element 16 for returning to the former state, the movable contact element 16 is suddenly inverted to induce leftward jump of the outer beam portion 16B and rightward jump of the inner beam portion 16A in FIG. 1.

Therefore, the normally-closed contacts held in electric conduction are opened by the abutment of the contact portion 16C against the fixed contact element 18 for the normally-closed contact, hence interrupting the main circuit.

Meanwhile, the cross bar 21 is pulled by an upper end 16F of the outer beam portion 16B and is thereby shifted leftward in FIG. 1, so that the projection 21G serves to displace the normally-open movable contact element 25 leftward. Consequently, the normally-open movable contact element 25 is brought into abutment against the normally-open fixed contact element 24 to eventually cause electric conduction.

Therefore, by connecting the normally-closed contact in series with the operating coil circuit (not shown in detail) of an electromagnetic contactor (not shown) which switches ON and OFF the main circuit, it is rendered possible to interrupt and protect the main circuit upon occurrence of an overcurrent condition in the load (not shown) such as an induction motor. Furthermore, an overload alarm signal may be produced by connecting an alarm lamp or equivalent circuit in series with the normally-open contact element.

After generation of thermal energy from the heater 4 is ceased as a result of interruption of the main circuit current and the bimetal 3 is cooled to resume the former state, both the normally-open and normally-closed contact elements can be returned to the former positions thereof by external manual actuation to depress the reset bar 26 downward in FIG. 1. When the reset bar 26 is manually depressed downward in FIG. 1 against the elasticity of the return spring 27, the inclined portion 26A of the reset bar 26 presses rightward the curved back portion 24A of the normally-open fixed contact element 24, which is thereby bent rightward in FIG. 1. Consequently, the normally-open movable contact element 25 held in abutment against the normally-open fixed contact element 24 is displaced rightward, so that the cross bar 21 is also displaced rightward in FIG. 1 with its projection 21G being pressed by the back surface 25A of the normally-open movable contact element 25.

In the conventional thermally-sensible overcurrent protective relay as illustrated in FIGS. 1–7, the power-source side main circuit terminal 40 is coupled to the heater 4 by welding so that if the main circuit terminal 40 is unwantedly vibrated by a switching shock of the electromagnetic contactor (not shown) or the like which is connected to this main circuit terminal 40, this mechanical stress is applied to the welded portion between the main circuit terminal 40 and the heater 4, and thus the heater 4 wound around the bimetal 3 may possibly be disconnected or damaged.

The fore ends 3A (the bottom portions viewed in FIG. 1) of the bimetals 3 of the individual phases need to simultaneously contact the communicating plate 8. To realize such simultaneous contact, it is necessary to adjust the fore end 3A of the bimetal 3 by plastic deformation of the tongue 5A of the load-side main circuit terminal 5 to which the upper end of the bimetal 3 is coupled and secured. Therefore, it would take time for the adjustment, and the costly assembling would be required.

Further, since the load-side main circuit terminal 5, which is secured to the bimetal 3, is anchored to the case 1 merely by the clamp screw 6 (see FIG. 4), when the size of the case 1 made of a synthetic resin contracts due to aging or some other reasons, the clamp screw 6 would be loosened so as to change the position of the bimetal 3. This is likely to vary the operation current against a possible overcurrent.

This invention has been accomplished to solve the above problems, and it is therefore an object of the present invention to provide a thermally-sensible overcurrent protective relay in which the power-source-side main circuit terminal, bimetal retainer and bimetal are integrally secured to one another, so that the occurrence of possible disconnection or damage of the heater caused by mechanical vibration, shock, etc. can be reduced and the position of the bimetal can be quickly, easily adjusted.

It is another object of this invention to provide a thermally-sensible overcurrent protective relay with high reliability, which can retain its proper operating current even if the size of resin case contracts due to its aging, etc. thereby to loosen a clamp screw.

SUMMARY OF THE INVENTION

The above objects and other features of the present invention are accomplished by providing a thermally-sensible overcurrent protective relay 200 comprising:

a normally-closed contact (58; 59; 60);

an operation device (54; 55) for performing an open/-close operation of the normally-closed contact (58; 59; 60);

a plurality of bimetals (3) through which the same current flows as that flowing a main circuit to be controlled;

a communicating plate (8) for transmitting mechanical deforming force of the bimetals (3) to the operation device (54; 55) so as to open the normally-closed contact (58; 59; 60);

a heater (4), mounted on each of the bimetals (3) and electrically coupled to at least one of a main circuit terminal (40) for a power source side and a main circuit terminal (5) for a load side, for, when generating heat, producing a mechanical deformation on said bimetals (3);

a bimetal retainer (50), electrically coupled to said one of the main circuit terminals (40; 5), for securing one end of each of said bimetals (3); and, a heater holder (51) having a first groove (51A) for securely holding said one of the main circuit terminals (40; 5), second groove (51B) for securely holding a connecting section between the bimetal retainer (50) and the bimetals (3), and a pin (51C) fitted in a through hole (50C) formed in the bimetal retainer (50).

In a thermally-sensible overcurrent protective relay 200 according to a first preferred embodiment, the connecting section between a power-source-side main circuit terminal, a bimetal retainer and a bimetal mounted with a heater are made integral by a heater holder that is made of an electrically insulating material, and the power-source-side main circuit terminal is electrically coupled to the heater. Even when this main circuit terminal is vibrated by a switching shock or the like of such a component as an electromagnetic contactor, therefore, the stress caused by the vibration is applied over the heater holder so that it does not adversely influence the heater mounted on the bimetal so much.

In accordance with a thermally-sensible overcurrent relay 200 of a second preferred embodiment, a heater holder has its pin fitted in a through hole formed in a bimetal retainer and makes the power-source-side main circuit terminal, bimetal retainer and bimetal integral by the fore end of this pin fitted in a through hole bored in a case, is rotatable around the pin. Therefore, by rotating the heater holder, when assembled in the case, the position of the fore end of the bimetal with respect to a communicating plate can easily be adjusted. In addition, the fore end of the heater holder, after assembled in the case, is secured to the periphery of the through hole of the case with an adhesive resin, so that even when a clamp screw fixing the bimetal retainer to the case is loosened by contraction of the case due to its aging, the bimetal retainer remains secured to the case and the bimetal formed integral with the bimetal retainer does not change its position.

BRIEF DESCRIPTION OF THE DRAWINGS

For a better understanding of the invention as well as other objects and further features thereof, reference is made to the following description which is to be read in conjunction with the accompanying drawings, in which.

DETAILED DESCRIPTION OF THE PREFERRED EMBODIMENTS

General Description

Referring now to FIGS. 8 through 20, a description will be made of a thermally-sensible overcurrent protective relay 200 according to one preferred embodiment, which is directed to the reliable heater arrangement.

Figure 8:
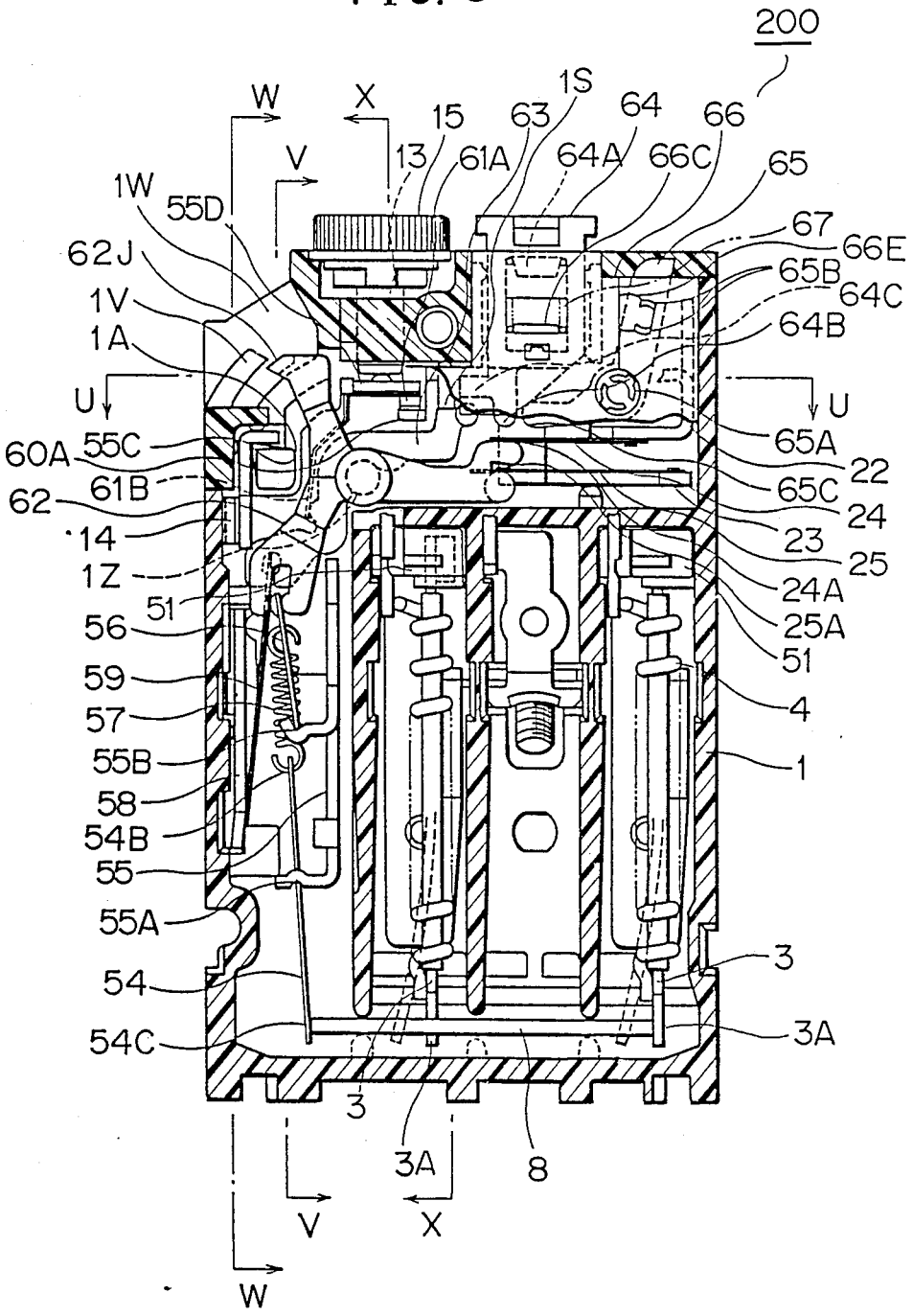
FIG. 8 is a longitudinal section of a thermally-sensible overcurrent protective relay, according to a first embodiment of the present invention, shown with its cover removed.
Figure 9:
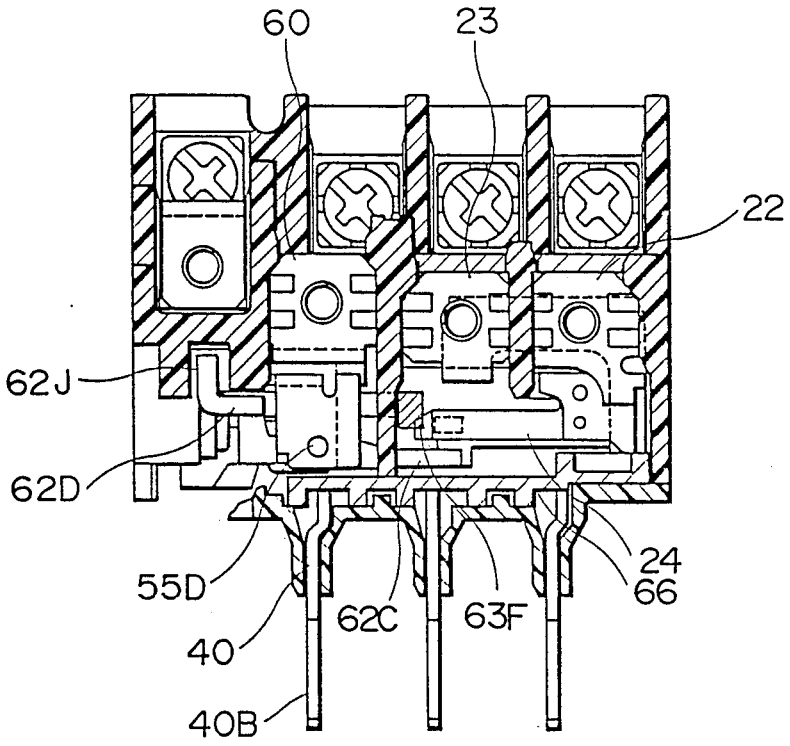
FIG. 9 is a cross-sectional view taken along a line U—U in FIG. 8.
Figure 10:
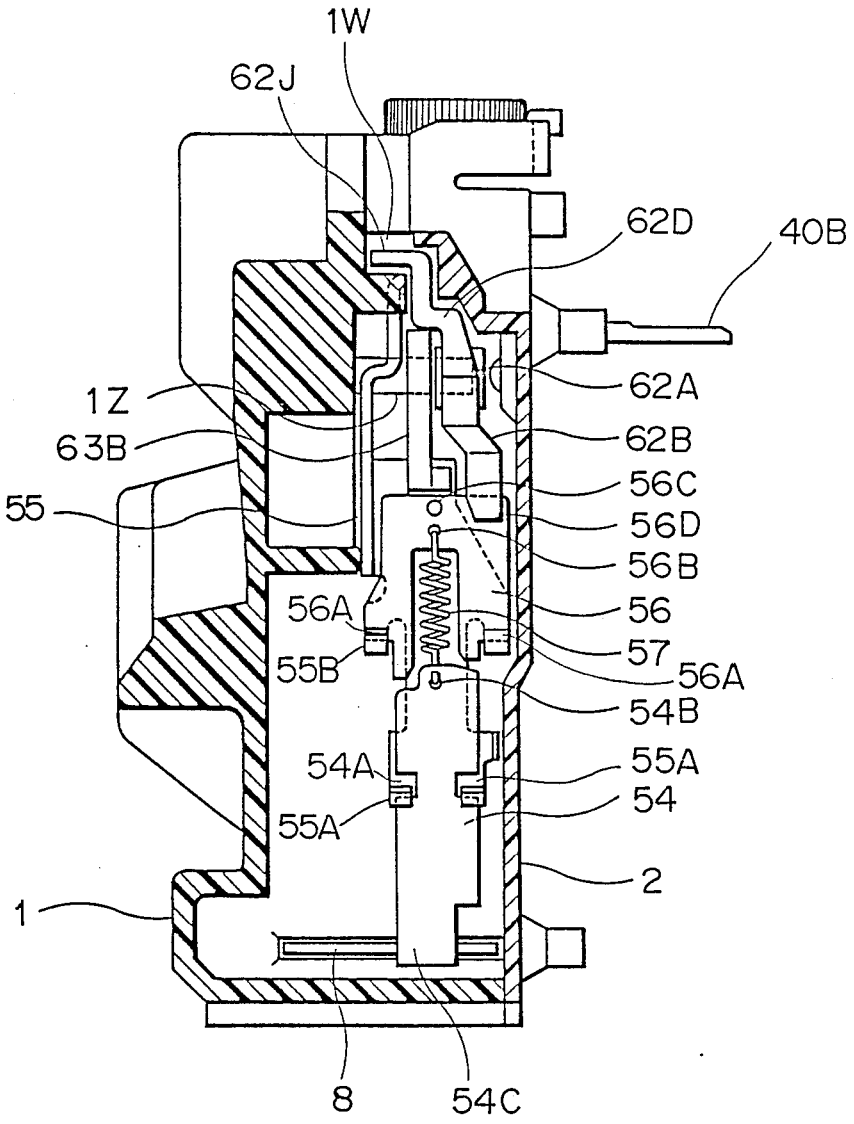
FIG. 10 is a longitudinal sectional view taken along a line V—V in FIG. 8.
Figure 11:
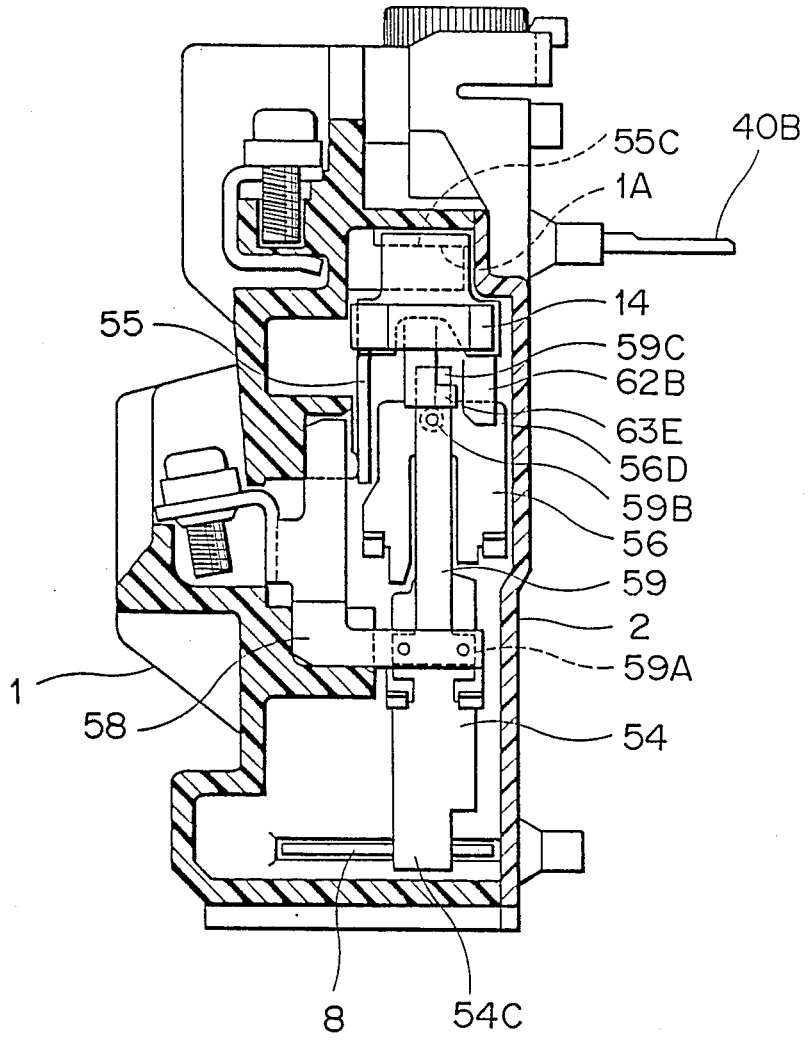
FIG. 11 is a longitudinal section taken along a line W—W in FIG. 8.
Figure 12:
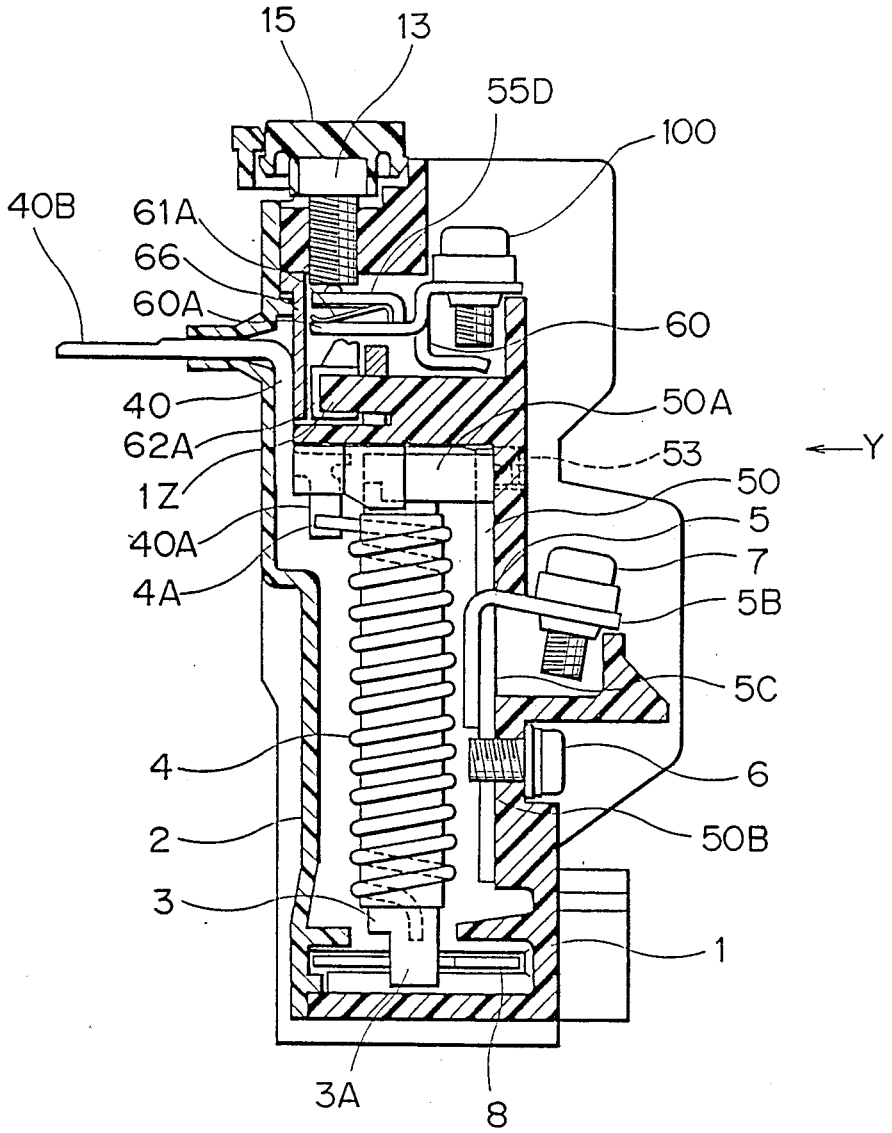
FIG. 12 is a longitudinal section taken along a line X—X in FIG. 8.
Figure 13:
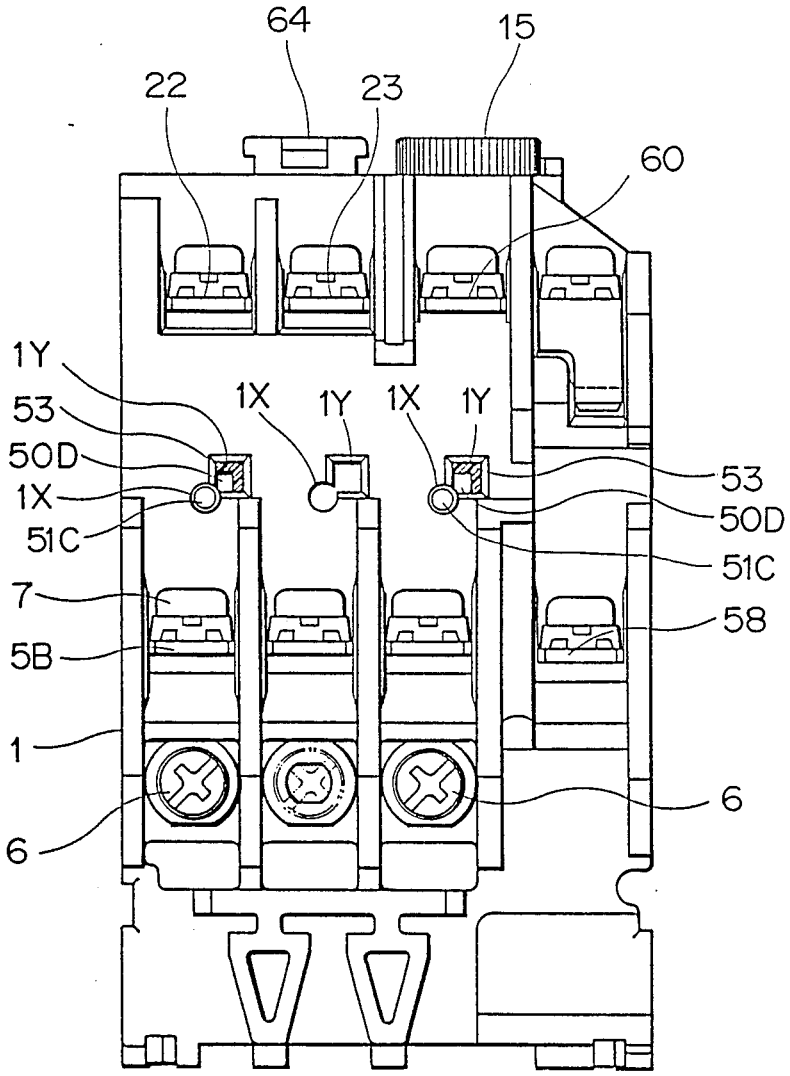
FIG. 13 is a side view of the thermally-sensible overcurrent protective relay shown in FIG. 12.
Figure 14:
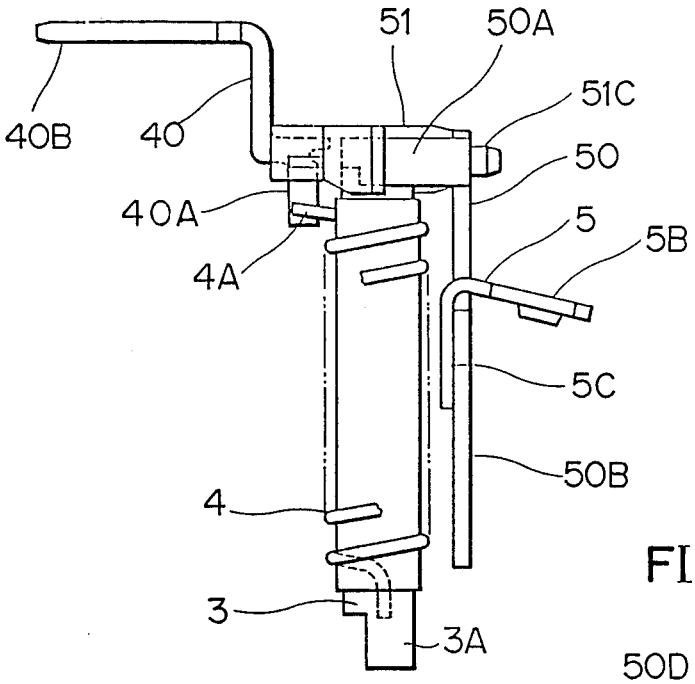
FIGS. 14 through 16 are respectively a plan view, a front view, and a left side view of a heating element employed in the thermally-sensible overcurrent protective relay of FIG. 8.
Figure 16:
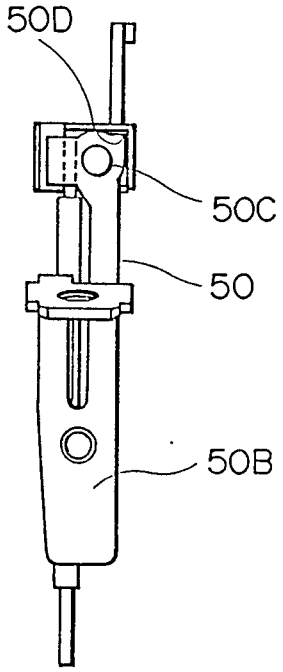
Figure 15:
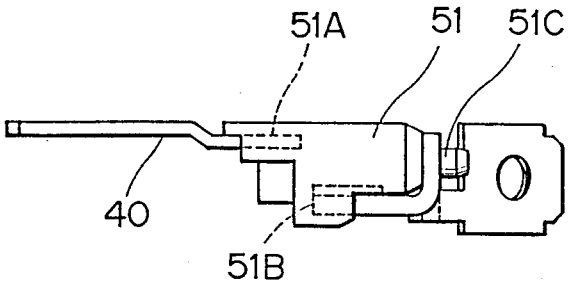
Figure 17:
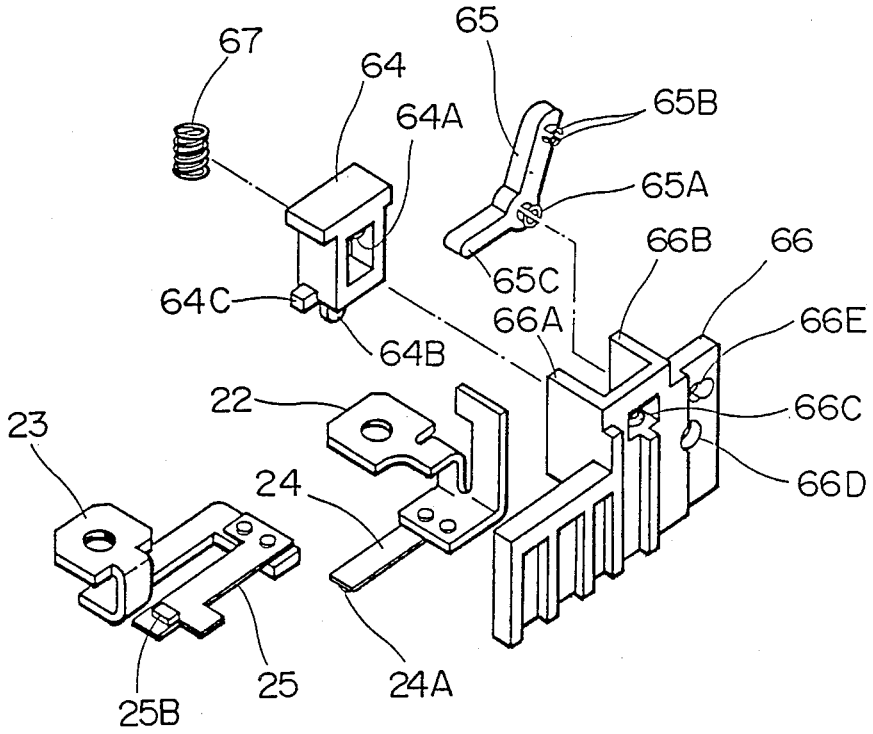
FIG. 17 is an exploded perspective view of component elements of normally-open contact elements and a reset mechanism employed in the thermally-sensible overcurrent protective relay of FIG. 8.
Figure 18:
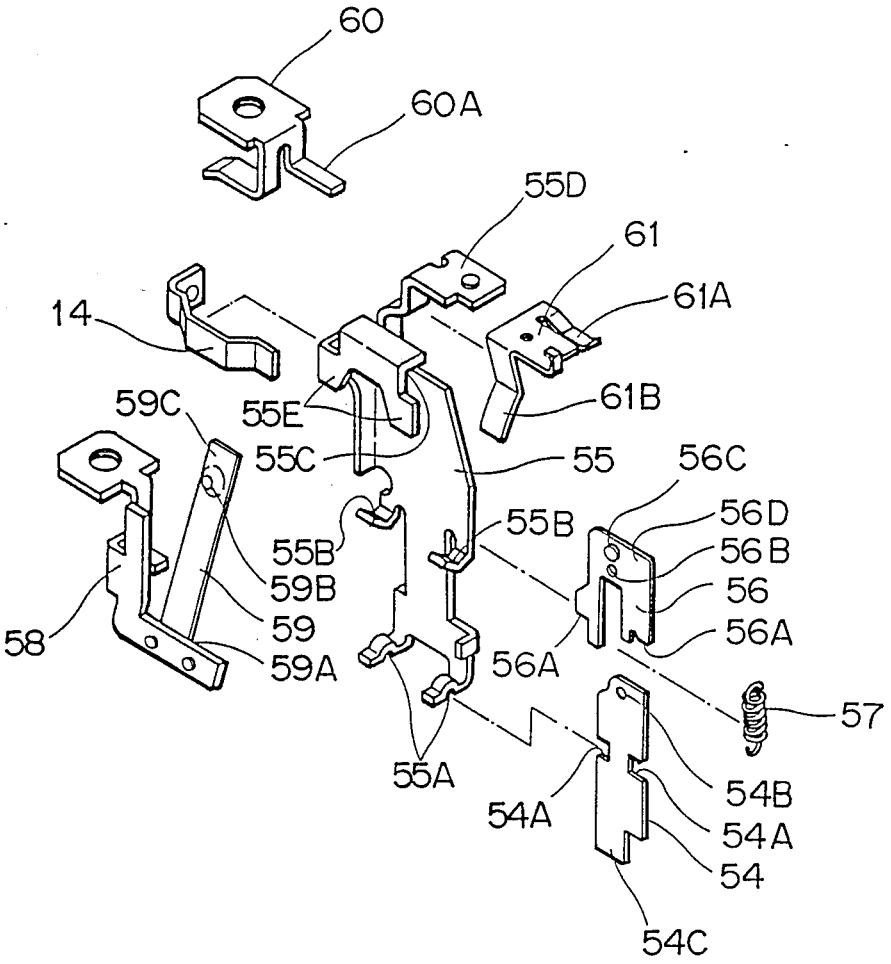
FIG. 18 is an exploded perspective view of component elements of normally-closed contact elements and a snapping inverter employed in the thermally-sensible overcurrent protective relay of FIG. 8.
Figure 20:
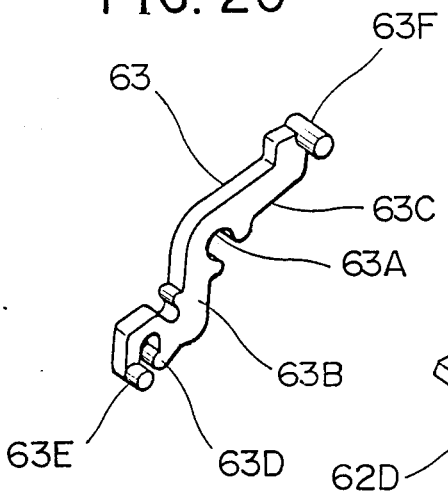
FIGS. 19 and 20 are perspective views of a first lever and a second lever, respectively employed in the thermally-sensible overcurrent protective relay of FIG. 8.
Figure 19:
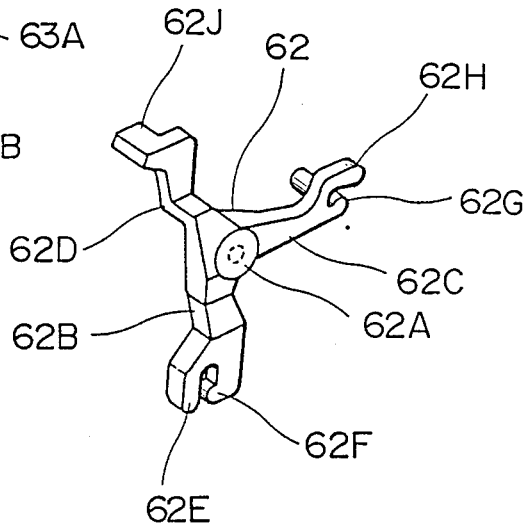

FIG. 8 is a longitudinal section of the thermally-sensible overcurrent protective relay 200; FIG. 9 is a cross-sectional view taken along a line U—U in FIG. 8; FIG. 10 is a longitudinal section taken along a line V—V in FIG. 8; FIG. 11 is a longitudinal section of basic component elements taken along a line W—W in FIG. 8; FIG. 12 is a sectional view taken along a line X—X in FIG. 8; FIG. 13 is a side view of the thermally-sensible overcurrent protective relay 200 seen from the direction of an arrow Y in FIG. 12; FIGS. 14 through 16 are respectively a plan view, a front view, and a left side view of a heating element; FIG. 17 is an exploded perspective view of component elements in normally-open contact elements and a reset mechanism; FIG. 18 is an exploded perspective view of component elements in normally-closed contacts and a snapping inverter; and FIGS. 19 and 20 are exploded perspective views of a first lever and a second lever, respectively.

It should be noted that in FIGS. 8 through 20, the component elements corresponding to those shown in FIGS. 1 through 7 are denoted by the same reference numerals.

Construction of Overcurrent Protective Relay Circuit Terminals

In FIG. 8, there are shown a case 1 and a cover 2, and each of bimetals 3 for individual phases (three phases in this embodiment also, but the center bimetal cannot be observed) is mainly heated by a heater 4 energized by a main circuit current and is thereby deformed with a curvature as represented by a dotted line in FIG. 8. That is, leftward deformation is induced, as viewed in FIG. 8.

A load-side main circuit terminal 5 (FIG. 12) is shaped into an "L", and a terminal screw 7 for connecting a load-side main circuit (external circuit) is screwed to one end 5B of such L-shaped terminal 5, while another end 5C thereof is connected electrically and mechanically to a bimetal retainer, or supporting member 50 by means of welding or the like. The bimetal retainer 50 is joined and anchored, at its tongue 50A, to an upper end of the bimetal 3 both electrically and mechanically by welding or similar means.

As illustrated in FIGS. 12, and 14 to 16, an upper end 4A of the heater 4 is electrically connected to one end 40A of a main circuit terminal for a power supply side 40 by means of welding or the like. Meanwhile, a left end 40B of the terminal 40 is screwed to a terminal of a power supply circuit used for an electromagnetic contactor (not shown) and so forth.

Heating Element

In FIG. 13, a heater holder 51 made of heat-resistant resin support the main circuit terminal for the power supply side 40 in its first groove 51A to secure this terminal. There is also formed a second groove 51B in the heater holder 51 for supporting and securing the joint of a tongue 50A of the bimetal retainer 50 and the upper end of the bimetal 3. The heater holder 51 further has, at its right end, as viewed in FIG. 15, a columnar pin 51C which is inserted into a through hole 50C formed at the upper end of the bimetal retainer 50. As illustrated in FIGS. 14 to 16, the heater holder 51 has a function of integrally joining the peripheral component parts of the main circuit and the heating element including the main circuit terminal for the power supply side 40, the bimetal retainer 50, the bimetal 3 and the heater 4. The heating element 52 thus integrally assembled as illustrated in FIGS. 14 to 16 is housed in a case 1 shown in FIG. 8. In this stage, the fore end, or tip of the pin 51C of the heater holder 51 is inserted into a through hole 1X formed in the case 1 of FIG. 13 which is a view from the direction of an arrow Y in FIG. 12. After the respective fore ends 3A of the bimetals 3 for the individual phases are so adjusted as to be positionally coincident with one another in a rotatable state around the pins 51C, the lower end 50B of the bimetal retainer 50 is anchored to the case 1 by the use of a clamp screw 6 as illustrated in FIG. 12. Subsequently, the hole 1Y in the case 1 of FIG. 13 is filled with a bonding resin 53. Then, the rotational position of the bimetal 3 shown in FIG. 8 is completely established as the bonding resin 53 is hardened in the space formed between an angular portion 50D of the bimetal retainer 50 and the hole 1Y as represented by the hatching in FIG. 13.

Communicating Plate and Lever Supporting Member

A communicating plate 8 for transmitting the bending torque of the heated bimetal 3 is kept in engagement with the fore end of the bimetal 3 of each phase, and the plate 8 is so disposed that its left end presses a lower end 54C of a temperature compensating bimetal 54 as illustrated in FIG. 8. A lever supporting member 55 has a pair of first fulcrums 55A in its lower portion and a pair of second fulcrums 55B in its upper portion. A normally-closed movable contact element 56 is composed of an electrically conductive thin metal plate.

A pair of edges 54A (see FIG. 18) formed substantially at the center of the temperature compensating bimetal 54 are kept in abutment against the first fulcrums 55A of the lever supporting member 55, and a pair of edges 56A formed in lower portions of a normally-closed movable contact element 56 are kept in abutment against the second fulcrums 55B of the lever supporting member 55. Further, a tension coil spring 57 is interposed between a through hole 54B formed in an upper portion of the temperature compensating bimetal 54 and a through hole 56B formed in the normally-closed movable contact element 56.

The lever supporting member 55 is retained, at an inner corner 55C of its L-shaped bend, in abutment against the edge 1A of the case 1 and is thereby held at a fulcrum while being depressed against an adjusting screw 13 through a first tongue 55D. In the meanwhile, a second tongue 55E is elastically urged leftward in FIG. 8 by a leaf spring 14.

Consequently, the lever supporting member 55 is rotatable around the edge 1A of the case 1 in FIG. 8 by turning a control knob 15 disposed above the adjusting screw 13, so that the lower end 54C of the temperature compensating bimetal 54 can be positionally varied substantially in the horizontal direction, as viewed in FIG. 8. Thus, the operating current can be adjusted in response to the amount of the curvature of the bimetal 3.

Contact Elements

A normally-closed fixed contact element 59 (see FIG. 18) is composed of a thin metal plate having sufficient elasticity and conductivity, and is connected firmly at its lower portion 59A to a normally-closed fixed terminal 58 both electrically and mechanically by clinching or similar means. A contact point 59B provided on an upper portion of the fixed contact element 59 is disposed opposite to a contact point 56C on an upper portion of the normally-closed movable contact element 56, thereby constituting a normally-closed contact mechanism which functions with mutual abutment or separation of such two contact points.

The normally-closed fixed terminal 58 is pressed into and anchored to the case 1. Meanwhile, a normally-closed movable terminal 60 is also pressed into and anchored to the case 1, and its tongue 60A is kept in touch with a first spring portion 61A of a contact spring 61 attached to the first tongue 55D of the lever supporting member 55. The contact spring 61 is composed of a thin metal plate having sufficient elasticity and conductivity, and power supply to the movable element of the normally-closed contact is executed via a path extending sequentially from the normally-closed movable terminal 60 through the contact spring 61 and the lever supporting member 55 to the normally-closed movable contact element 56.

In FIGS. 8 and 9, the normally-open fixed terminal 22 and the normally-open movable terminal 23 are pressed into and anchored to the case 1. Each of the normally-open fixed contact element 24 and the normally-open movable contact element 25 is composed of a thin metal plate having sufficient elasticity and conductivity, and the right ends of such contact elements 24 and 25 are connected respectively to the normally-open fixed terminal 22 and the normally-open movable terminal 23 both electrically and mechanically by clinching or similar means.

The normally-open fixed contact element 24 and the normally-open movable contact element 25 have, at the respective left ends, a contact point 24A and a contact point 25A which are brought into mutual abutment or separation to constitute a normally-open contact mechanism. Moreover, the normally-open movable contact element 25 is actuated by a first lever 62 constituting a communicating means which operates the normally-closed contacts and the normally-open contacts in an interlocking manner.

First Lever

The first lever 62 is substantially Y-shaped as illustrated in the perspective view of FIG. 19 and is held rotatably with its central tubular portion 62A fitted to a shaft 1Z (see FIG. 8) projecting in the case 1. The first lever 62 has a first arm 62B, a second arm 62C and a third arm 62D extending in three directions from the central tubular portion 62A. The fore end, or tip of the first arm 62B is divided into two lobes 62E and 62F which hold the distal end 56D (see FIG. 11) of the movable contact element 56 therebetween. The fore end of the second arm 62C is divided into two lobes 62G and 62H between which the distal end of the normally-open movable contact element 25 (see FIG. 8) is interposed. Then, the fore end of the third arm 62D is shaped into a bent display tip 62J as illustrated in FIG. 19, and such display tip 62J projects toward a position corresponding to a window 1W in the case 1 (see FIG. 8).

Second Lever

As illustrated in FIG. 20, a second lever 63 has a semicircular tubular portion 63A substantially at its center in such a manner as to be rotatable with respect to the projecting shaft 1Z in the case 1 similarly to the first lever 62. The second lever 63 further has a first arm 63B and a second arm 63C extending in two different directions from the tubular portion 63A.

The fore end of the first arm 63B of the second lever 63 is divided into two protrusions 63D and 63E with a space formed therebetween, and the distal end 59C (see FIG. 18) of the normally-closed fixed contact element 59 is held in such space. Meanwhile, the fore end 63F of the second arm 63C is so disposed as to be depressed by an undermentioned reset bar 64 shown in FIG. 17. Accordingly, the second spring portion 61B of the contact spring 61 serves to push substantially a central portion of the first arm 63B of the second lever 63 leftward, as viewed in FIG. 8. The second lever 63 is elastically urged counterclockwise around the projecting shaft 1Z and is kept in abutment against the case 1 while being retained by a stopper 1S disposed in the case 1.

Reset Mechanism

A reset bar 64 and a changeover lever 65 shown in FIG. 17 are attached to the case 1 after being united with a reset bar case 66. The two sides of the reset bar 64 are slidably supported by guides 66A and 66B of the reset bar case 66 and are rendered vertically shiftable in FIG. 8. A return spring 67 compressed for elastic urge is interposed between a spring socket 64A in the reset bar 64 and a spring socket 66C in the reset bar case 66, so that the reset bar 64 is elastically urged upward by the return spring 67.

A first boss 64B formed in a lower portion of the reset bar 64 is so positioned as to press the upper surface of the normally-open fixed contact element 24, and a second boss 64C is so positioned as to press the fore end 63F of the second arm 63C of the second lever 63.

Contact Recovery Mechanism

For changing the recovery or reset system from a manual mode to an automatic mode posterior to the contact operation, the changeover lever 65 is so attached that its split pin 65A is fitted into a pin hole 66D formed in the reset bar case 66, whereby the changeover lever 65 is rendered rotatable around the pin hole 66D. A guide bore 66E is shaped substantially into an 8-shaped hole so as to set the changeover lever 65 selectively at a manual reset position or an automatic reset position. A pair of protrusions 65B of the changeover lever 65 are fitted into such guide bore 66E.

The state illustrated in FIG. 8 corresponds to a manual reset mode. An automatic reset mode is selected by rotating the changeover lever 65 counterclockwise with its fore end 65C pressing down the upper surface of the normally-open fixed contact element 59.

Overall Operation

A description will now be given on the overall operation performed in the thermally-sensible overcurrent protective relay 200 according to the preferred embodiment of the invention with reference to FIGS. 8 through 20.

In FIG. 12, a main circuit current flows from the main circuit terminal for the power supply side 40 via the heater 4, the bimetal 3 and the bimetal retainer 50 to the load-side main circuit terminal 5. An electric wire (not shown) is connected with the terminal screw 7 fastened to one end 5B of the L-shaped load-side main circuit terminal 5, and its other end is connected to a load (not shown) such as an induction motor. Consequently, the main circuit current corresponds to the load current.

Due to the Joule heat loss caused by such main circuit current flowing through the bimetal 3 and the heater 4, the bimetal 3 is heated and curved, or bent as represented by a dotted line in FIG. 8. This phenomenon is the same as in the aforementioned conventional example shown in FIG. 1.

Toggle Mechanism

Upon occurrence of an overload condition in the load, the main circuit current becomes higher than the above-described value to further increase the curvature of the bimetal 3 as represented by the dotted line in FIG. 8, hence causing its further leftward displacement as viewed in FIG. 8. As a result, the communicating plate 8 is pressed by the fore end of the bimetal 3 and is thereby displaced leftward in FIG. 8.

The temperature compensating bimetal 54 thus pressed leftward at its lower end 54 by the left end of the communicating plate 8 is rotated clockwise around the first fulcrum 55A of the lever supporting member 55. Due to such rotary motion, the through hole 54B formed in the temperature compensating bimetal 54 is shifted rightward, as viewed in FIG. 8. When the temperature compensating bimetal 54 thus rotated has reached a dead center point where the axis of the tension coil spring 57 in FIG. 8 or a straight line passing through the hole 54B in the temperature compensating bimetal and the hole 56B in the movable contact element is displaced rightward beyond a straight line passing through the hole 56B in the normally-closed movable contact element 56 and the second fulcrum 55B of the lever supporting member 55, then the tensile force of the coil spring 57 exerted to elastically urge the normally-closed movable contact element 56 is directionally changed. Therefore, the normally-closed movable contact element 56 is quickly rotated clockwise around the second fulcrum 55B of the lever supporting member 55. Until arrival of the temperature compensating bimetal 54 at the dead center point in this stage, the tensile force of the coil spring 57 is exerted for elastically urging the normally-closed movable contact element 56 counterclockwise around the second fulcrum 55B, thereby maintaining abutment of the contact point 56C against the contact point 59B. Further, the normally-closed fixed contact element 59 is pressed leftward in FIG. 8 by the tensile force of the coil spring 57 and then is brought to a halt position in abutment against the protrusion 63E of the second lever 63. In this manner, the normally-closed movable contact element 56 constitutes a toggle mechanism in cooperation with the tensile force of the coil spring 57. When the quick clockwise rotation of the normally-closed movable contact element 56 is effected beyond the dead center point as mentioned, the distal end 59C of the normally-closed fixed contact element 59 is allowed to follow the normally-closed movable contact element 56 up to a position in abutment against the protrusion 63D of the second lever 63 and then is restricted at such position. Thereafter, the normally-closed movable contact element 56 is continuously rotated clockwise so that the two contact points 56C and 59B are separated from each other to eventually open the normally-closed contacts.

Overtravel of Normally-Closed Contact Elements

An overtravel of the normally-closed contact elements is determined by the follow-up distance of the normally-closed fixed contact element 59 with respect to the normally-closed movable contact element 56 in the displacement from the position of abutment of the normally-closed fixed contact element 59 against the protrusion 63E of the second lever 63 to the position in abutment thereof against the protrusion 63D, and such overtravel is effective to enhance the contacting reliability of the normally-closed contact elements.

Overtravel of Normally-Open Contact Elements

With such quick clockwise rotation of the normally-closed movable contact element 56 mentioned above, the first lever 62 pressed rightward in FIG. 8 at its lobe 62F by the distal end 56D of the normally-closed movable contact element 56 is rotated counterclockwise around the projecting shaft 1Z. Therefore, the normally-open movable contact element 25 is pressed and deformed by the lobe 62G of the first lever 62, so that the contact point 25B is brought into abutment against the contact point 24A of the normally-open fixed contact element 24, thereby closing the normally-open contacts. Since the normally-open fixed contact element 24 is fabricated by a thin metal plate having sufficient elasticity, it is continuously pressed by the lobe 62G of the first lever 62 even after closing the contacts and is thereby further deformed upward together with the normally-open movable contact element 25. Such deformation proceeds successively until abutment of the normally-open fixed contact element 24 against the first protrusion 64B of the reset bar 64 and is ceased upon abutment of the normally-open fixed contact element 24 against the first protrusion 64B of the reset bar 64. At the position of such cease, the rotary motions of both the normally-closed movable contact element 56 and the first lever 62 are brought to a halt to complete the inversion or trip. The overtravel of the normally-open contacts is determined by the amount of deformation of the normally-open fixed contact element 24 after closing the normally-open contacts posterior to abutment of the contact point 25B against the contact point 24A (i.e., by the gap between the normally-open fixed contact element 24 and the first protrusion of the reset bar 64 in the initial state of FIG. 8), and such overtravel is effective to enhance the contacting reliability of the normally-open contact elements.

Due to the deformation of the normally-open fixed contact element 24 and the normally-open movable contact element 25 within the distance of such overtravel, the contact points 24A and 25A are caused to mutually slide horizontally in FIG. 8, hence removing any dust, dirt, oxide and so forth from the respective surfaces to eventually enhance the contacting reliability of the normally-open contacts.

Condition Displaying

In the stage of completion of the inversion or trip as mentioned above, the first lever 62 is at the extreme position of its counterclockwise rotation and therefore, the third arm 62D is also at the leftward extreme position, so that the display tip 62J at the fore end of the third arm 62D is hidden behind the wall 1V of the case 1 and is rendered invisible after completion of the inversion or trip, although it is visible in the initial state of FIG. 8 from outside through the window 1A of the case 1. Thus, the display tip 62J has a function of indicating a non-inverted or reset state when visible from outside through the window 1A of the case 1 and an inversion or trip completed state when invisible.

In addition to such operation-state indicating function, the display tip 62J has another function of executing a test trip. Generally, after the overcurrent protective relay of this type performs its contact inversion in response to an overload, a test trip is executed to check whether the normally-closed and normally-open contacts are properly connected with an external circuit to perform a required operation. In such a case, the contacts alone can be actuated by the display tip 62J without causing any current flowing in the main circuit.

Test Tripping

In the thermally-sensible overcurrent protective relay 200 according to the preferred embodiment, the above-described test tripping is carried out by the following procedure.

In the initial state illustrated in FIG. 8, the display tip 62J is manually displaced leftward in FIG. 8 by an external means. Then, the first lever 62 is rotated counterclockwise so that its lobe 62E presses the distal end 56D of the normally-closed movable contact element 56 rightward, as viewed in FIG. 8. When the hole 56B in the normally-closed movable contact element 56 has been shifted to the right beyond a straight line passing through the first fulcrum 55A and the second fulcrum 55B of the lever supporting member 55, the tensile force of the coil spring 57 is suddenly exerted in the reverse direction to consequently cause quick clockwise rotation of the normally-closed movable contact element 56. With such rotation of the normally-closed movable contact element 56 similar to the aforementioned inversion, the first lever 62 is rotated so that the normally-closed movable contact element 56 is inverted to complete the test trip.

Reset Operation

Subsequent to completion of such test trip, the reset bar 64 is manually depressed downward in FIG. 8 against the elasticity of the return spring 67. As a result, the first protrusion 64B of the reset bar 64 presses the lobe 62G of the first lever 62 downward in FIG. 8 via the normally-open fixed contact element 24 and the normally-open movable contact element 25. Then, the first lever 62 is rotated clockwise around the projecting shaft 1Z so that the normally-closed movable contact element 56 is displaced leftward while being pushed by the lobe 62F. When the hole 56B in the normally-closed movable contact element 56 has been shifted to the left beyond a straight line passing through the first fulcrum 55A and the second fulcrum 55B of the lever supporting member 55, the elastic urge of the tension coil spring 57 exerted clockwise on the normally-closed movable contact element 56 is suddenly reversed to be counterclockwise, whereby the normally-closed movable contact element 56 is rotated counterclockwise to return to the initial state illustrated in FIG. 8. Consequently, the distal end 56D of the normally-closed movable contact element 56 pushes the lobe 62E of the first lever 62, which is thereby quickly rotated clockwise to resume the initial reset state as illustrated in FIG. 8, hence opening the normally-open contacts and closing the normally-closed contacts.

Opening Normally-Closed Contact Elements

A description will now be given on how the normally-closed contact elements are opened.

In the initial state as illustrated in FIG. 8, such operation is performed by manually depressing the reset bar 64 downward in FIG. 8. When the reset bar 64 is depressed against the elasticity of the return spring 67, the second protrusion 64C of the reset bar 64 is brought into abutment against the fore end 63F of the second arm 63C of the second lever 63 to push the same downward. Accordingly, the second lever 63 is rotated clockwise, as viewed in FIG. 8, around the projecting shaft 1Z against the elasticity of the second spring portion 61B of the contact spring 61, so that the protrusion 63D of the second lever 63 comes to press the distal end 59C of the normally-closed fixed contact element 59 leftward. Consequently, the normally-closed fixed contact element 59 is deformed leftward. In this stage, the normally-closed movable contact element 56 follows the normally-closed fixed contact element 59 up to a position where the first lever 62 is rotatable clockwise, i.e., to a position where the lobe 62G of the first lever 62 abuts against the stopper 1T of the case 1. Thereafter, however, the normally-closed movable contact element 56 is restrained with its distal end 56D abutting against the lobe 62E of the first lever 62 and thereby ceases the follow-up action, so that the contact points 56C and 59B are separated from each other to thus open the normally-closed contacts. Upon release of the reset bar 64 from the manual pressure, the reset bar 64 is returned to the former position thereof, as illustrated in FIG. 8. Accordingly, the second lever 63 is also released and returned to the former position of FIG. 8 by the elastic urge of the second spring portion 61B of the contact spring 61, whereby the normally-closed contacts are closed.

Figure 1:
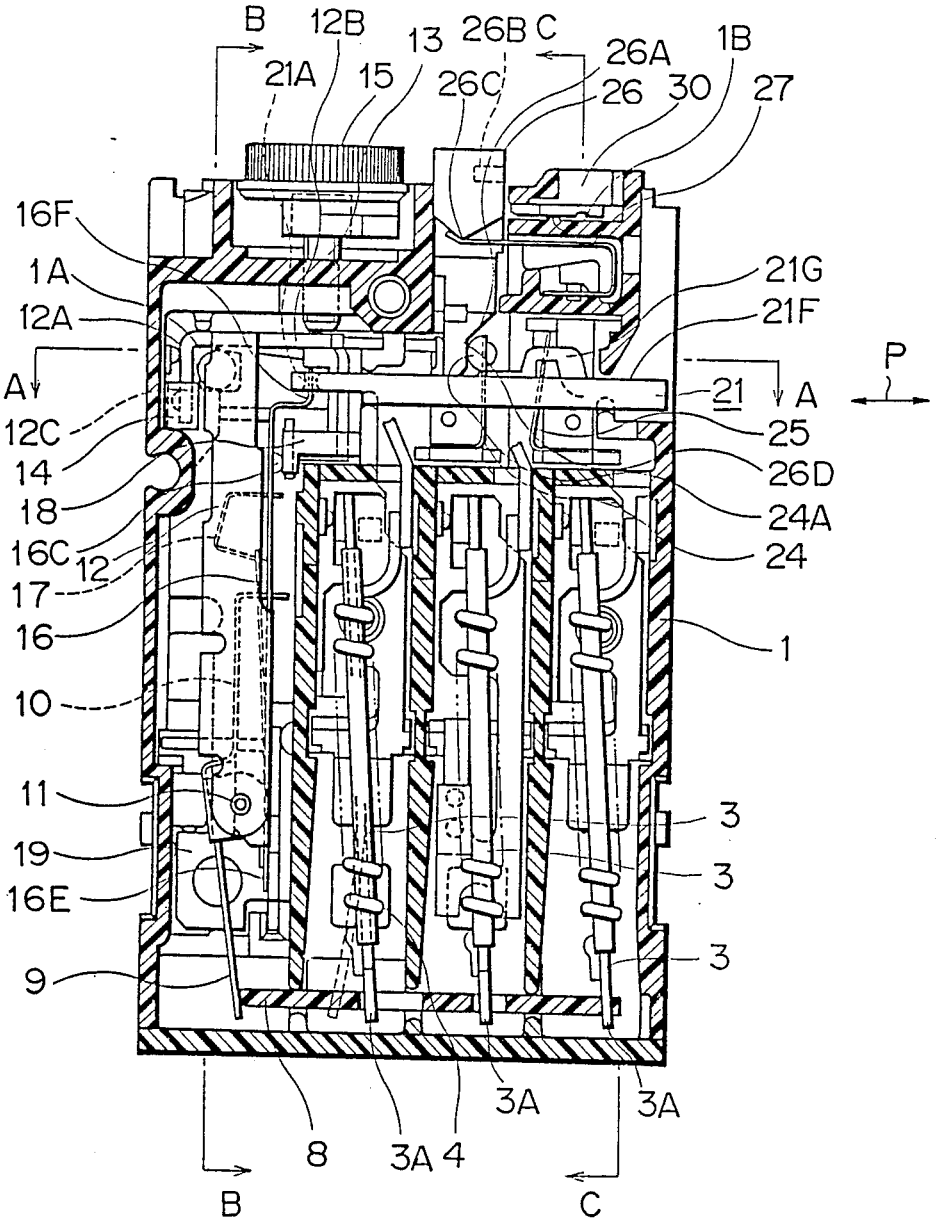
FIG. 1 PRIOR ART
FIG. 1 is a longitudinal section of a conventional thermally-sensible overcurrent protective relay.
Figure 2:
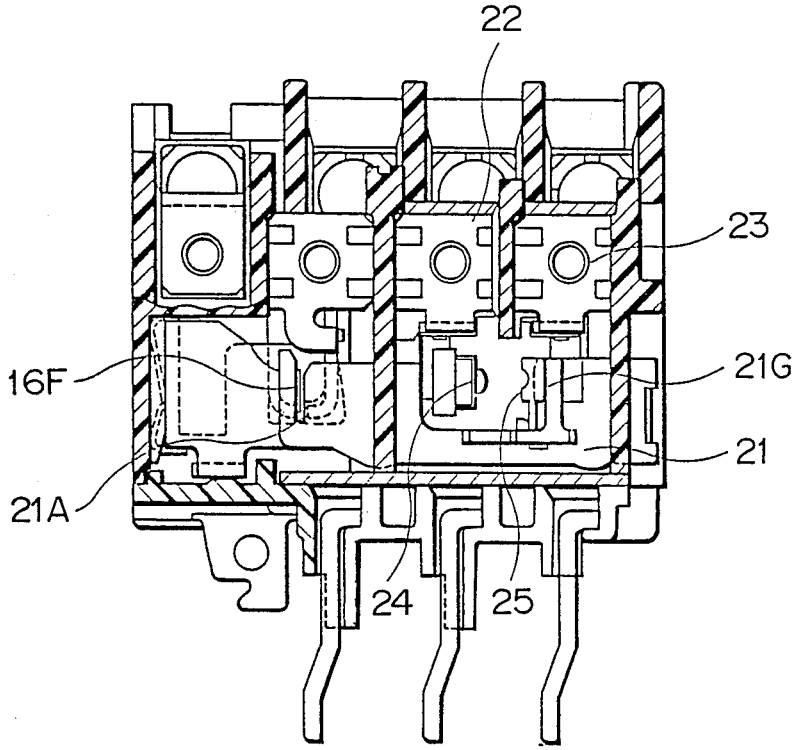
FIG. 2 PRIOR ART
FIG. 2 is a cross-sectional view taken along a line A—A in FIG. 1.
Figure 3:
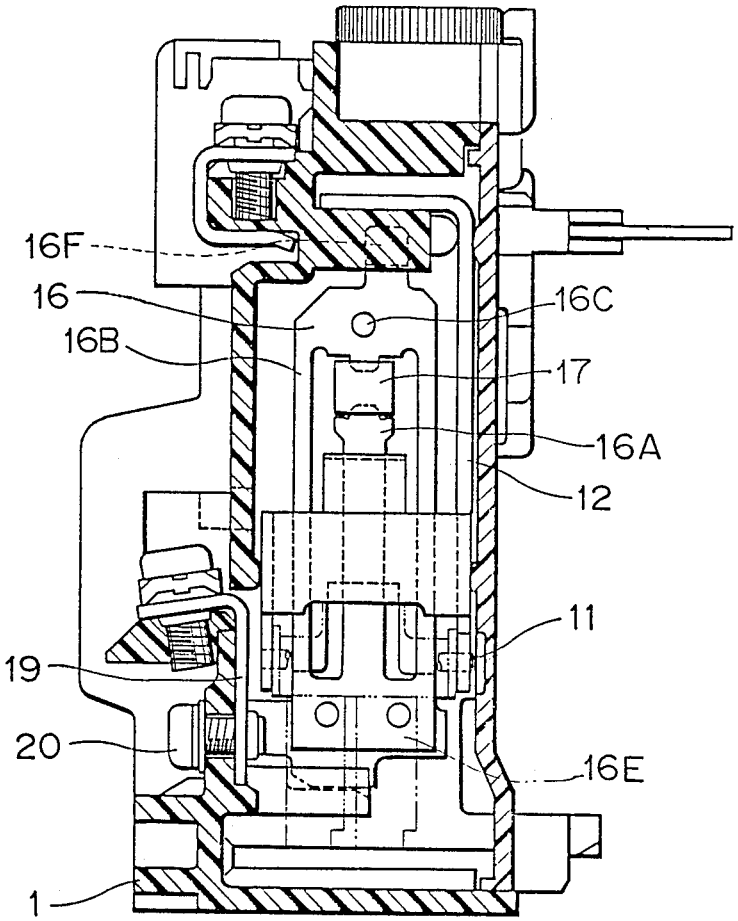
FIG. 3 PRIOR ART
FIG. 3 is a longitudinal section taken along a line B—B in FIG. 1.
Figure 4:
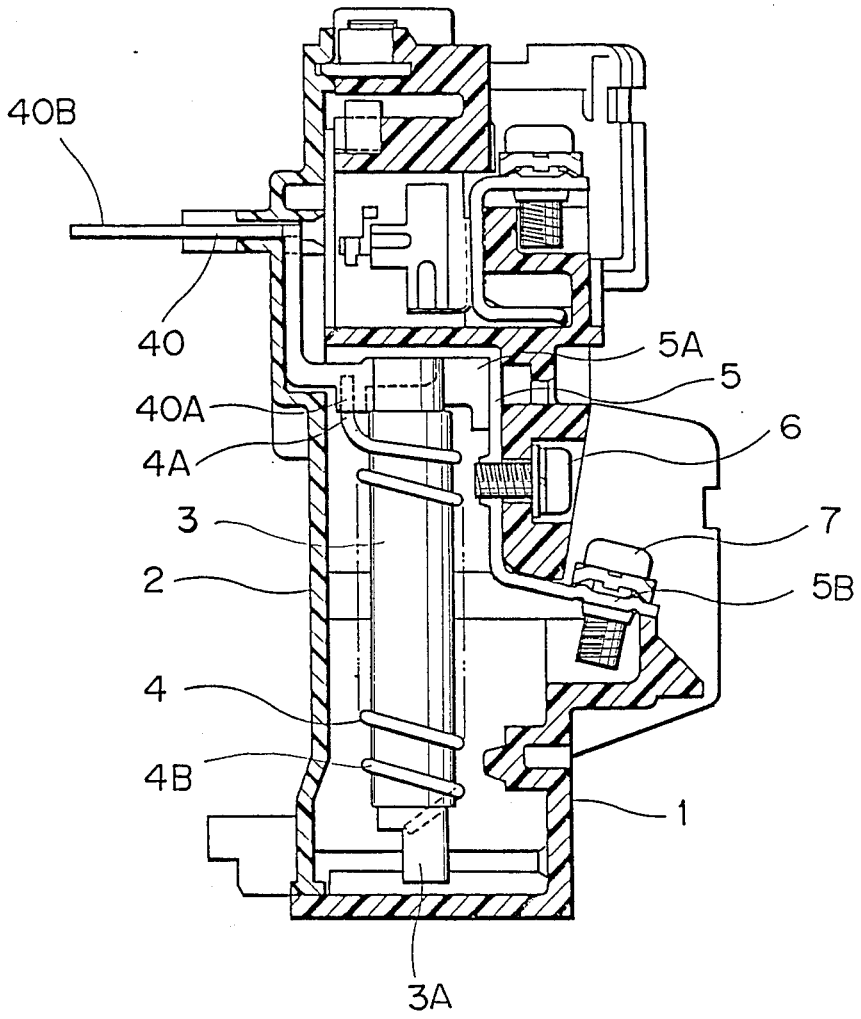
FIG. 4 PRIOR ART
FIG. 4 is a longitudinal section taken along a line C—C in FIG. 1.
Figure 5:
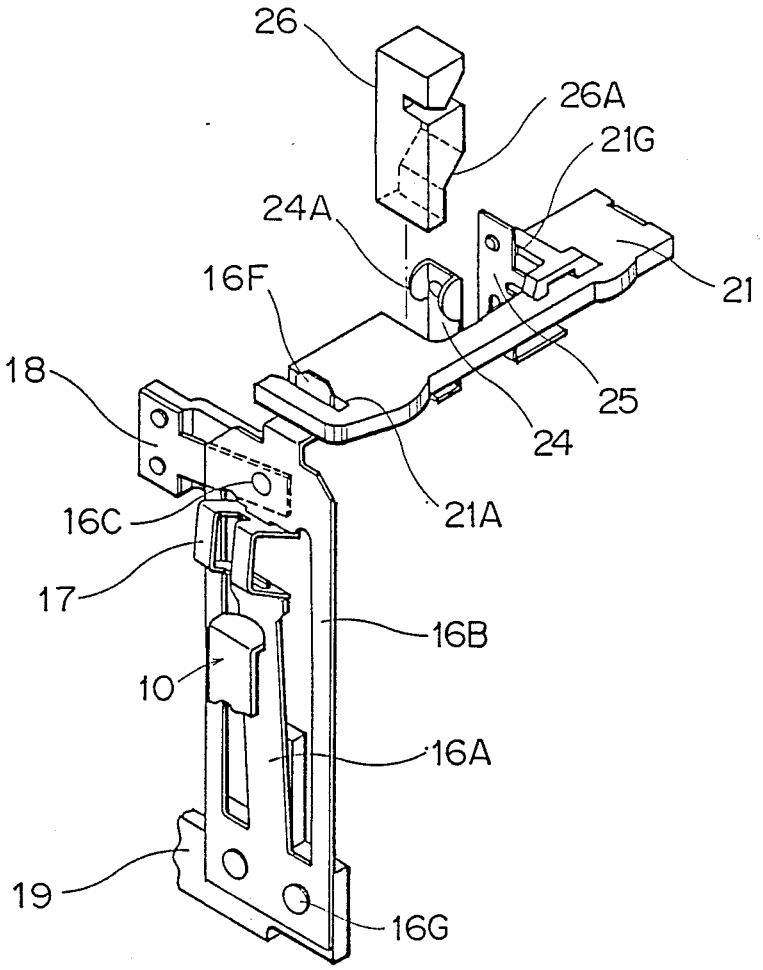
FIG. 5 PRIOR ART
FIG. 5 is a perspective view illustrating basic component elements of a snapping inverter employed in the conventional thermally-sensible overcurrent protective relay.
Figure 6:
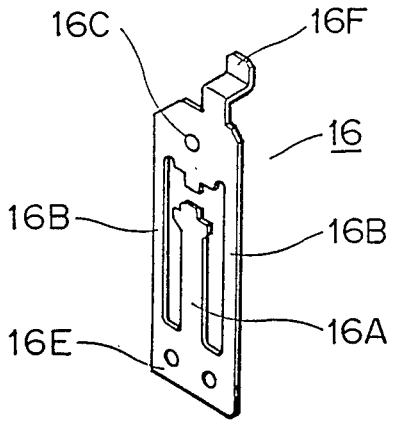
FIG. 6 PRIOR ART
FIG. 6 is a perspective view of a movable contact element employed in the conventional thermally-sensible overcurrent protective relay.
Figure 7:
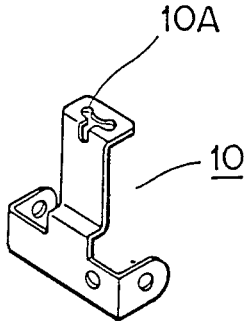
FIG. 7 PRIOR ART
FIG. 7 is a perspective view of an actuating lever employed in the conventional thermally-sensible overcurrent protective relay.

Similar to the conventional thermally-sensible overcurrent protective relay shown in FIG. 1, the normally-closed contact elements 56 and 59 are connected in series with the operating coil circuit of an electromagnetic contactor (not shown) which serve to switch a main circuit current, and the normally-open contacts are used for switching an alarm lamp (not shown).

Heater Supporting Member

As previously described with reference particularly to FIG. 15, the heater holder 51 is made of the heat-resistant resin.

The heater holder 51 securely holds at the first groove 51A the power-source-side main circuit terminal 40 and at the second groove 51B the connection section between the tongue 50A of the bimetal retainer 50 and the bimetal 3. Further, the cylinder pin 51C formed at the right end of the heater holder 51 is fitted in the through hole 50C bored in the bimetal retainer 50.

According to this embodiment, as illustrated in FIG. 12, the connecting section between the power-source-side main circuit terminal 40, the tongue 50A of the bimetal retainer 50 and the bimetal 3 mounted with the heater 4 are made integral by the heater holder 51 that is made of an electrically insulating material (see FIGS. 14–16), and the power-source-side main circuit terminal 40 is simply electrically coupled to the heater 4. Even when this main circuit terminal 40 is mechanically vibrated by a switching shock or the like of such a component as an electromagnetic contactor (not shown) adapted to be coupled to the main circuit terminal 40, therefore, the mechanical stress caused by the vibration is directly applied on the heater holder 51 so that it does not adversely influence the heater 4 wound on the bimetal so much. This prevents the heater 4 from being disconnected or damaged by the vibration-originated stress.

Aging Protection

In addition, the heater holder 51 has its pin 51C (see FIG. 14) fitted in the through hole 50C (see FIG. 16) formed in the bimetal retainer 50 and makes the power-source-side main circuit terminal 40, bimetal retainer 50 and bimetal 3 integral by the fore end of this pin 51C fitted in the through hole 1X (see FIG. 13) bored in the case 1, is rotatable around the pin 51C. Therefore, by rotating the heater holder 51, the position of the fore end of the bimetal 3 with respect to the communicating plate 8 can easily be adjusted.

In addition, the fore end of the heater holder 51, after assembled in the case 1, is secured to the periphery of the through hole 1X of the case 1 with an adhesive resin as illustrated in FIG. 13, so that even when the clamp screw 6 (see FIG. 12) fixing the lower portion of the bimetal retainer 50 to the case 1 is loosened by contraction of the case 1 due to its aging, the bimetal retainer 50 remains secured to the case 1 and the bimetal 3 formed integral with the bimetal retainer 50 does not change its position. Accordingly, the operating current of the relay 200 with respect to the overcurrent protection does not change. Moreover, as illustrated in FIG. 13, the through hole 1Y is bored in that portion of the case 1 which corresponds to the angular portion 50D of the bimetal retainer 50, and when this hole 1Y is filled with the adhesive resin 53, the adhesive resin 53 in the hatched space shown in FIG. 13 between the corner portion 50D and the hole 1Y is hardened so as to secure the bimetal retainer 50 to the case 1. This retains the bimetal retainer 50 securely fixed to the case 1 even when the case 1 contracts due to its aging. In addition, the bimetal retainer 50 can be further secured to the case 1 by fixing the clamp screw 6 (see FIG. 13), which fixes the bimetal retainer 50 to the case 1, to the periphery of the through hole of the case 1 with the adhesive resin.

Thermally-Sensitive Overcurrent Protective Relay Operable in Second Mode

Figure 21:
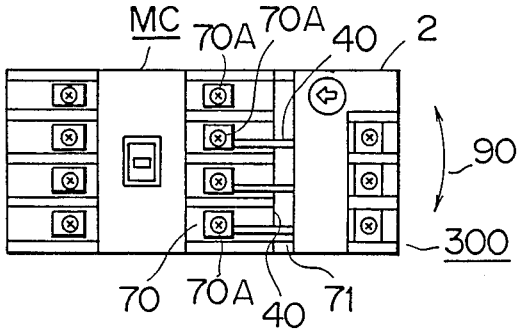
FIG. 21 is a plan view of a thermally-sensible protective relay 300 according to another preferred embodiment of the present invention.
Figure 22:
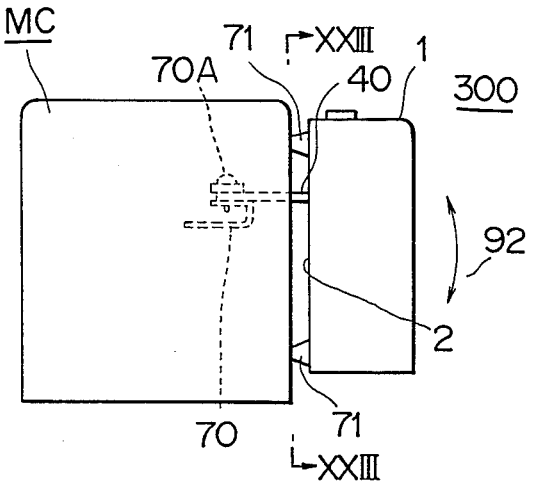
FIG. 22 is a front view of the relay 300 shown in FIG. 21.
Figure 23:
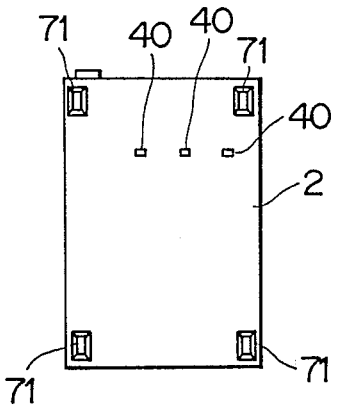
FIG. 23 is a longitudinal section taken along line XXIII—XXIII of FIG. 22.

FIGS. 21 to 23 illustrate a modification of this invention; FIG. 21 is a plan view, FIG. 22 a front view, and FIG. 23 a cross-sectional view as taken along line XXIII—XXIII in FIG. 22. In this embodiment, the thermally-sensitive overcurrent protective relay can be mounted on an electromagnetic contact quickly and easily.

In the diagrams, reference numeral 300 is a thermally-sensitive overcurrent protective relay, 1 is a case and 2 is a cover. The frame constituted by these case 1 and cover 2 accommodates the same overcurrent protective relay mechanism as is used in the aforementioned embodiment. Reference numeral 70 is a main circuit terminal of an electromagnetic contact MC, 40 is, as mentioned earlier, a power-source-side main circuit terminal of the relay 300, and 71 are four projections provided at the individual corners of the surface of the cover 2 that faces the electromagnetic contactor MC. These projections have the same height and are arranged to surround the main circuit terminal 40 as illustrated in FIG. 23.

Attachment to Electromagnetic Contactor

Attaching the relay 300 to the electromagnetic contactor MC completes by fastening the main circuit terminal 40 of the relay 300 to the main circuit terminal 70 of the electromagnetic contactor MC by means of a screw 70A, so that the projections 71 formed on the surface of the relay 300 which is opposite to the corresponding surface of the contactor MC, are abutted to this surface of the contactor MC. Therefore, this attachment is done quickly and easily.

According to thus constructed relay 300 and electromagnetic contactor MC, when the relay 300 is attached to this electromagnetic contactor MC, the projections 71 of the same height, which are provided at the respective corners of the opposite surface of the relay 300 so as to surround the relay's main circuit terminal 40, abut on the opposite surface of the contactor MC that faces the above-described opposite surface of the relay 300. When unwanted rotational force in the vertical direction 90 in FIG. 21 or in the vertical direction 92 in FIG. 22 is applied to the relay 300, therefore, the projections 71 of the relay 300 serve to restrict the movement of the relay 300. Accordingly, the relay 300, when attached to the electromagnetic contactor MC, is prevented from being rocked in the vertical or horizontal direction. This prevents the main circuit terminal 40 of the relay 300 from being damaged or broken by the applied bending force, thus eliminating the need to improve the mechanical strength of the relay's main circuit terminal 40.

According to this embodiment, four projections 71 were provided on the opposite surface of the relay 300 that faces the corresponding surface of the electromagnetic contactor MC. As a modification, however, four projections (not shown) may be provided on the opposite surface of the electromagnetic contactor MC that faces the above-described opposite surface of the relay 300 and may still realize the same effects as has been explained above.

While has been explained above, according to this invention, the connecting section between the power-source-side main circuit terminal, the bimetal retainer and the bimetal mounted with the heater are made integral by the heater holder formed of an electrical insulating material, and the mechanical stress generated by a switching shock or the like of such a component as an electromagnetic contactor, is applied on the heater holder. Consequently, such a mechanical stress does not adversely influence the heater wound on the bimetal so much and thus prevents the heater from being disconnected or damaged.

Further, the fore end of the pin of the heater holder, which is fitted in the through hole formed in the bimetal retainer, is fitted in the through hole bored in the case, and the heater holder is rotatable around this pin. Therefore, by rotating the heater holder, when assembled in the case, the position of the fore end of the bimetal with respect to the communicating plate can easily be adjusted. In addition, the fore end of the heater holder, after assembled in the case, is secured to the periphery of the through hole of the case with the adhesive resin. Even when the clamp screw fixing the bimetal retainer to the case is loosened by contraction of the case due to its aging, therefore, the bimetal retainer remains secured to the case and the bimetal formed integral with the bimetal retainer does not change its position, and the operation current of the relay with respect to the overcurrent protection does not vary.

Moreover, according to this invention, projections are formed on either the case of the overcurrent protective relay or the case of an external electronic component such as an electromagnetic contactor, adapted to be coupled to this relay. This simplifies the attachment of the relay to the external electronic component as well as prevents the relay's main circuit terminal from being damaged by applied mechanical bending force.

What is claimed is:

1. A thermally-sensible overcurrent protective relay comprising:

normally-closed contact means;

operation means for performing an open/close operation of said normally-closed contact means;

a plurality of bimetals through which the same current flows as that flowing a main circuit to be controlled;

a communicating plate for transmitting mechanical deforming force of said bimetals to said operation means so as to open said normally-closed contact means;

a heater, mounted on each of said bimetals and electrically coupled to at least one of a main circuit terminal for a power source side and a main circuit terminal for a load side, for, when generating heat, producing a mechanical deformation on said bimetals;

a bimetal retainer, electrically coupled to said one of said main circuit terminals, for securing one end of each of said bimetals; and, a heater holder having a first groove for securely holding said one of said main circuit terminals, a second groove for securely holding a connecting section between said bimetal retainer and said bimetals, and a pin fitted in a through hole formed in said bimetal retainer.

2. A thermally-sensible overcurrent protective relay as claimed in claim 1, wherein said heater holder is made of a electrically insulating material.

3. A thermally-sensible overcurrent protective relay as claimed in claim 1, further comprising a case, made of a synthetic resin, for enclosing all of said relay components.

4. A thermally-sensible overcurrent protective relay comprising:

normally-closed contact means;

operation means for performing an open/close operation of said normally-closed contact means;

a plurality of bimetals through which the same current flows as that flowing a main circuit to be controlled;

a communicating plate for transmitting mechanical deforming force of said bimetals to said operation means so as to open said normally-closed contact means;

a heater, mounted on each of said bimetals and electrically coupled to at least one of a main circuit terminal for a power source side and a main circuit terminal for a load side, for, when generating heat, producing a mechanical deformation on said bimetals;

a bimetal retainer, electrically coupled to said one of said main circuit terminals, for securing one end of each of said bimetals;

a heater holder having a first groove for securely holding said one of said main circuit terminals, second groove for securely holding a connecting section between said bimetal retainer and said bimetals, and a pin fitted in a through hole formed in said bimetal retainer;

a case for enclosing all of said relay components; and tightening means for tightening said bimetal retainer after a fore end of said pin of said heater holder, which is fitted in said through hole of said bimetal retainer, is fitted in a through hole formed in said case and is secured to a peripheral portion of said through hole of said case by an adhesive resin.

5. A thermally-sensible overcurrent protective relay as claimed in claim 4, wherein said heater holder is made of an electrically insulating material.

6. A thermally-sensible overcurrent protective relay as claimed in claim 1, wherein said case is made of a synthetic resin.

* * * * *